US011959268B2

(12) United States Patent
Hagman

(10) Patent No.: US 11,959,268 B2
(45) Date of Patent: Apr. 16, 2024

(54) SHOWER DRAIN SYSTEM AND A SHOWER OR SHOWER CABIN

(71) Applicant: Enduce AB, Umeå (SE)

(72) Inventor: Henrik Hagman, Umeå (SE)

(73) Assignee: Enduce AB, Umeå (SE)

( * ) Notice: Subject to any disclaimer, the term of this patent is extended or adjusted under 35 U.S.C. 154(b) by 0 days.

(21) Appl. No.: 18/267,574

(22) PCT Filed: Dec. 15, 2021

(86) PCT No.: PCT/EP2021/085917

§ 371 (c)(1),
(2) Date: Jun. 15, 2023

(87) PCT Pub. No.: WO2022/129183

PCT Pub. Date: Jun. 23, 2022

(65) Prior Publication Data

US 2024/0052621 A1 Feb. 15, 2024

(30) Foreign Application Priority Data

Dec. 16, 2020 (SE) ..... 2030364-0

(51) Int. Cl.
*E03F 5/04* (2006.01)
*E03C 1/00* (2006.01)
*F28D 21/00* (2006.01)

(52) U.S. Cl.
CPC ..... *E03F 5/0408* (2013.01); *E03C 1/00* (2013.01); *F28D 21/0012* (2013.01); *E03C 2001/005* (2013.01)

(58) Field of Classification Search
CPC .... E03F 5/0408; E03C 1/00; E03C 2001/005; F28D 21/0012
USPC ..... 165/47
See application file for complete search history.

(56) References Cited

U.S. PATENT DOCUMENTS 1,938,064 A 12/1933 Carmine
3,526,547 A 9/1970 Shock
4,372,372 A * 2/1983 Hunter ..... F28D 7/024 165/47

(Continued)

FOREIGN PATENT DOCUMENTS

DE 29615555 U1 10/1996
EP 2345851 A2 7/2011

(Continued)

OTHER PUBLICATIONS

International Preliminary Report on Patentability for International Application No. PCT/EP2021/085917 dated Nov. 2, 2022 (14 pages).

(Continued)

*Primary Examiner* — Jon T. Schermerhorn, Jr.
(74) *Attorney, Agent, or Firm* — RMCK Law Group, PLC

(57) ABSTRACT

A shower drain system for recovering thermal energy from a flow of shower greywater comprises: a drain cup for receiving shower greywater, and a heat exchanger arranged downstream of the drain cup, the heat exchanger being configured to heat a flow of incoming cold water with the shower greywater, wherein the drain cup comprises a nozzle arranged and configured to supply hot water into the drain cup.

12 Claims, 3 Drawing Sheets

(56) References Cited

U.S. PATENT DOCUMENTS

| | | | | |
|---|---|---|---|---|
| 4,398,308 | A * | 8/1983 | Berg | A47K 3/28 4/596 |
| 4,542,546 | A * | 9/1985 | Desgagnes | E03C 1/12 4/596 |
| 4,619,311 | A | 10/1986 | Vasile et al. | |
| 9,481,987 | B2 | 11/2016 | Salzer | |
| 9,777,932 | B2 * | 10/2017 | Hagman | F24D 17/0005 |
| 10,006,645 | B1 * | 6/2018 | Howard | F28D 7/028 |
| 10,087,610 | B2 * | 10/2018 | Salzer | E03C 1/304 |
| 10,125,480 | B2 * | 11/2018 | Breton | E03C 1/284 |
| 11,333,440 | B2 * | 5/2022 | Nobile | F24D 17/0005 |
| 11,725,374 | B2 * | 8/2023 | Nahum | E03C 1/288 4/286 |
| 2014/0304901 | A1 | 10/2014 | Salzer | |
| 2016/0169538 | A1 | 6/2016 | Hagman et al. | |

FOREIGN PATENT DOCUMENTS

| | | | |
|---|---|---|---|
| GB | 2052698 | A | 1/1981 |
| GB | 2232749 | A | 12/1990 |
| JP | 2020196994 | A | 12/2020 |

OTHER PUBLICATIONS

International Search Report and Written Opinion for International Application No. PCT/EP2021/085917 dated Mar. 23, 2022 (14 pages).

Swedish Search Report for Swedish Application No. 2030364-0 dated Aug. 24, 2021 (5 pages).

* cited by examiner

SHOWER DRAIN SYSTEM AND A SHOWER OR SHOWER CABIN

CROSS-REFERENCE TO RELATED APPLICATIONS

This application is a 371 U.S. National Stage of International Application No. PCT/EP2021/085917, filed Dec. 15, 2021, which claims priority to Swedish Patent Application No. 2030364-0, filed Dec. 16, 2020. The disclosures of each of the above applications are incorporated herein by reference in their entirety.

FIELD OF THE INVENTION

The present inventive concept relates to shower drain systems for recovering thermal energy from a flow of shower greywater. The present inventive concept also relates to showers or shower cabins comprising such shower drain systems.

BACKGROUND OF THE INVENTION

A shower typically comprises a shower head fluidly connected to a shower mixer configured to mix hot water from a hot water supply and cold water from a cold water supply. The hot water supply may e.g. be water heated by a domestic boiler (using a combustible fuel, electricity, district heating, or a heat pump). Thus, showers are energy intensive units, consuming a lot of energy to heat the hot water used during showering.

Devices which recover heat from the shower greywater (i.e. the wastewater discharged from a shower floor into a shower drain system) are known from the prior art, e.g. from GB2232749, U.S. Pat. No. 4,619,311, GB2052698 and DE29615555. Such devices are typically installed in the shower drain system to recover heat from the shower greywater, for example from a shower basin, using a plate heat exchanger with a high thermal efficiency. However, since the heat exchanger, and the shower drain system, are prone to fouling, e.g. caused by grease deposits, hair products like conditioners, and debris such as hair or textile fibers in the shower greywater, the shower greywater system will get blocked and/or the efficiency of the heat exchanger reduced over time. The more heat energy the heat exchanger recycles, i.e. removes from the shower greywater, the more prone it is to fouling as the removal of thermal energy results in that solidification of e.g. grease and waxes. Thus, cleaning of heat recycling shower drain system is crucial.

Cleaning of the shower drain system, and the heat exchanger in particular, is time consuming, cumbersome, may expose the user to detergents, and is often perceived as disgusting. Thus, there is a need in the industry for an improved shower drain system.

SUMMARY

An object of the inventive concept is to overcome the above problems, and to provide a shower drain system for recovering thermal energy from a flow of shower greywater which is improved compared to prior art solutions, by providing a configuration enabling easy and effective cleaning of the system. Hereby, problems related to fouling, drain blockage, or partial drain blockage, caused by deposited grease, shower products and/or debris in the shower greywater may be reduced or even avoided. Thus, the thermal energy recovering of the system may be improved. Moreover, the shower drain system of the present inventive concept is relatively simple, cost efficient and user-friendly. This, and other objects, which will become apparent in the following, are accomplished by means of a shower drain system, and a shower or shower cabin comprising such shower drain system.

The present inventive concept is based on the insight that an easy and effective cleaning of the system can be performed by providing a hot water supply via a nozzle into the drain cup. Hereby, direct supply of hot water to the drain cup, via the nozzle, may be accomplished and with the result of an efficient removal of debris and/or fouling in the system downstream of nozzle. Moreover, by supplying hot water by the nozzle, waxes and grease may be melted, and removed from the system. By the arrangement of the nozzle to supply hot water into the drain cup, and not e.g. in a conduit connecting the drain cup and the heat exchanger, a larger part of the shower drain system will be subjected to the supplied hot water, and thus, a larger part of the shower drain system may be efficiently cleaned.

According to at least a first aspect of the present inventive concept, a shower drain system for recovering thermal energy from a flow of shower greywater is provided. The system comprises:

- a drain cup for receiving shower greywater,
- a heat exchanger arranged downstream of the drain cup, the heat exchanger being configured to heat a flow of incoming cold water with the shower greywater,
- wherein the drain cup comprises a nozzle arranged and configured to supply hot water into the drain cup.

Hereby, an improved shower drain system is provided including enabling easy and effective cleaning of the system. As previously stated, by providing a nozzle arranged configured to supply hot water into the drain cup, an efficient removal of debris and/or fouling in the system may be accomplished. In more detail, by arranging the nozzle in the drain cup, the supply of hot water into the system can be controlled, and utilized, in an improved manner compared to e.g. providing a nozzle in the conduit between the drain cup and the heat exchanger. For example, when hot water is supplied via the nozzle, the drain cup itself is subject to the supply of hot water and may thus be cleaned. Moreover, by arranging the nozzle in the drain cup, the flow of the supplied hot water can be controlled by the specific form and dimension of the drain cup (e.g. by enabling an ejector function as will be further described below), with a larger degree of freedom compared to if the nozzle is arranged in the conduit between the drain cup and the heat exchanger. The nozzle may be referred to as a hot water nozzle. For example, the material of the nozzle, and/or any gaskets or seals or the like are adapted for the supply of such hot water.

According to at least one example embodiment, the nozzle is arranged and configured to supply hot water from a hot water supply. The hot water supply may e.g. be a central hot water supply, potentially arranged to supply hot water also to a shower mixer. The hot water supply may be a hot tap water supply. The temperature of the hot water from the hot water supply is e.g. between 45° C. and 65° C., and preferably between 50° C. and 65° C. According to at least one example embodiment, the nozzle is arranged and configured to supply hot water from a hot water supply being different to a heated water from a shower mixer.

According to at least one example embodiment, the nozzle is arranged and configured to supply hot tap water into the drain cup. For example, the material of the nozzle, and/or any gaskets or seals or the like are adapted for the supply of such hot tap water.

According to at least one example embodiment, the nozzle is fluidly connected to the hot water supply. That is, when the shower drain system is installed in a shower, or a shower cabin (or a shower tray), the nozzle is connected to the hot water supply for supplying hot water into the drain cup. Alternatively, the hot water supply is comprised in the shower drain system.

According to at least one example embodiment, the shower drain system comprises a nozzle connecting conduit arranged to fluidly couple the nozzle to tap water.

According to at least one example embodiment, the nozzle connecting conduit comprises a downstream end portion and an upstream end portion. The nozzle is typically comprised in, or is attached to, the downstream end portion of the nozzle connecting conduit. The upstream end portion of the nozzle connecting conduit typically comprises a coupling to tap water, or hot tap water. Hereby, hot tap water may be transferred to the nozzle via the nozzle connecting conduit. The nozzle connecting conduit is typically different to any conduit coupled to the heat exchanger. That is, according to at least one example embodiment, the nozzle, and/or the nozzle connecting conduit is externally connected relative to the heat exchanger. Stated differently, the nozzle, and/or the nozzle connecting conduit is not connected to the heat exchanger, and/or is not forming a part of the heat exchanging circuit thereof. In other words, the nozzle, and/or the nozzle connecting conduit is arranged to provide hot water independently of the heat exchanger, typically by providing hot tap water.

According to at least one example embodiment, the drain cup is arranged and configured to, when hot water is supplied to the drain cup via the nozzle, act as an ejector by that the hot water acts as a motive fluid, forming a pumping effect within the shower drain system.

Hereby, an efficient removal of debris and/or deposits in the system is accomplished. Thus, the drain cup is arranged and configured to enable an ejector function, when hot water is supplied to the drain cup via the nozzle. That is, the nozzle and the drain cup is arranged and configured to act as an ejector when hot water is supplied to the drain cup via the nozzle. The ejector function may be described as the function of transporting and increasing the total pressure of one fluid using another fluid with a relatively high velocity to achieve a pumping effect. Such ejector function may be accomplished, and improved, by various measures as described in the following. It should be understood that the ejector function is at least partly dependent on the pressure of the supplied hot water to the nozzle. Thus, the various measures as described in the following are typically based on a pressure of the supplied hot water of between 0.5 and 10 bar gauge (barg), preferably between 1 and 7 barg. For embodiment in which the hot water is tap hot water, the pressure of the supplied tap hot water is the normal operating pressure of the tap water. Thus, the shower drain system may be configured to be connected to tap water, at least by that the nozzle is configured to be connected to tap water.

According to at least one example embodiment, at least a portion of the drain cup is formed as an ejector, i.e. such portion being an ejector portion. The ejector portion may comprise the nozzle and an ejector diffusor portion. The ejector diffusor portion is typically arranged opposite the nozzle. In other words, the nozzle may be arranged to face the ejector diffusor portion. That is, the nozzle and the ejector diffusor portion are axially aligned, or at least partly axially aligned. By arranging the nozzle to face the ejector diffusor portion, the nozzle is configured to inject hot water (e.g. a stream or jet of hot water) towards, and possibly into, the ejector diffusor portion to increase the pressure of any fluid present in the ejector diffusor portion. Thus, the above mentioned ejector function is enabled as the fluid in the drain cup may be transported and subject to an increased pressure by the supplied hot water from the nozzle.

According to at least one example embodiment, the drain cup comprises a drain cup inlet for receiving the shower greywater, and a drain cup outlet for discharging shower greywater to the heat exchanger, wherein the nozzle is arranged downstream of the drain cup inlet and upstream of the drain cup outlet and is arranged and configured to face the drain cup outlet.

Such arrangement of the nozzle is advantageous, as the hot water can be supplied into the drain cup in an efficient and controllable manner. Hereby, an efficient removal of fouling in the system may be accomplished, e.g. by the previously described ejector function. Thus, the nozzle is arranged and configured to direct a stream, or jet, of hot water towards, and possibly into, the drain cup outlet. Stated differently, the nozzle and the drain cup outlet are axially aligned, or at least partly axially aligned. By arranging the nozzle to face the drain cup outlet, the above mentioned ejector function is enabled as the fluid in the drain cup may be transported and subject to an increased pressure by the supplied hot water from the nozzle.

Moreover, a backflow of contaminated greywater from the blocked or partially blocked shower drain system into the shower tray/floor is avoided.

It should be understood that when stating that the nozzle is axially aligned, or at least partly axially aligned, with the drain cup outlet, and/or the ejector diffusor portion, a centre axis of the nozzle extends further into the drain cup outlet, and/or ejector diffusor portion. Thus, the centre axis may be a common centre axis for the nozzle and the drain cup outlet, and/or ejector diffusor portion (i.e. axially aligned). Alternatively, the centre axis of the nozzle is extending into the drain cup outlet, and/or ejector diffusor portion parallel to a respective centre axis of the drain cup outlet, or ejector diffusor portion.

According to at least one example embodiment, the centre axis of the nozzle is defined relative to a radial cross section e.g. making up an orifice of the nozzle (in case of a single orifice). That is, for an orifice of the nozzle, e.g. being defined by a radial cross section of the nozzle, the centre axis extends centrally of, and perpendicular to, such radial cross section.

According to at least one example embodiment, the ejector diffusor portion comprises a tubular pipe section having a main extension in the direction of the centre axis of the ejector diffusor portion, wherein the nozzle is arranged to face the tubular pipe section. Hereby, the above mentioned ejector function is enabled as the fluid in the drain cup, and the tubular pipe section of the ejector diffusor portion, may be transported and subject to an increased pressure by the supplied hot water from the nozzle. Typically, the tubular pipe section is arranged in between the nozzle and the drain cup outlet.

According to at least one example embodiment, the previously described ejector diffusor portion is arranged between the nozzle and the drain cup outlet, the ejector diffusor portion having at least a converging section and/or a diverging section. Thus, the tubular pipe section of the ejector diffusor portion comprises a converging section and/or a diverging section. Typically, a converging section implies that the cross sectional area decreases along the centre axis towards the drain cup outlet. Correspondingly, a diverging section implies that the cross sectional area increases along the centre axis towards the drain cup outlet. According to at least one example embodiment, the ejector diffusor portion comprises a throat in the interface between the converging and diverging sections. Such throat may e.g. have a diameter of 20 mm-50 mm, such as about 30 mm.

Hereby, the ejector function, when hot water is supplied to the drain cup via the nozzle, may be accomplished and/or improved.

According to at least one example embodiment, the ejector diffusor portion comprises the drain cup outlet.

According to at least one example embodiment, the ejector diffusor portion comprises a constant area section arranged between the converging and diverging sections. Alternatively, the ejector diffusor portion comprises the constant area section and one of the converging and diverging sections. For example, the ejector diffusor portion comprises the constant area section arranged adjacent the converging section or diverging section. For example, the ejector diffusor portion may comprise the converging section arranged upstream of the constant area section. According to another example, the diverging section is arranged downstream of the constant area section. Hereby, the ejector function, when hot water is supplied to the drain cup via the nozzle, may be accomplished and/or improved. According to at least one example embodiment, the ejector diffusor portion comprises only a constant area section. Thus, the tubular pipe section may solely be formed by a constant area section arranged between the nozzle and the drain cup outlet.

Hereby, the ejector function, when hot water is supplied to the drain cup via the nozzle, may be improved. The constant area section may e.g. have a diameter of 20 mm-50 mm, such as about 30 mm.

According to at least one example embodiment, the diverging section is an asymmetrical diverging section.

Hereby, entrapped gas, e.g. air bubbles, may escape out from the system. Thus, reduction of flow of shower greywater due to entrapped gas can be avoided or reduced.

According to at least one example embodiment, the drain cup inlet is arranged as a horizontal cross section of the drain cup, and the drain cup outlet is arranged as a vertical cross section of the drain cup. Thus, flow of shower greywater may enter into the drain cup by the horizontal cross section of the drain cup inlet, and turn as it exit the drain cup by the vertical cross section of the drain cup outlet.

According to at least one example embodiment, the drain cup comprises internal walls formed as a cup, e.g. having a bottom wall and an enveloping side wall extending perpendicular from the bottom wall to an oppositely arranged opening, forming the drain cup inlet. The enveloping side wall be at least partly cylindrically shaped. The nozzle is preferably arranged in the enveloping side wall. According to at least one example embodiment, the nozzle is arranged in the lower half of the drain cup, e.g. closer to the bottom wall than to the drain cup inlet. According to at least one example embodiment, the previously described ejector diffusor portion is preferably arranged as a protruding portion, e.g. a horizontally protruding portion, extending outwards from the enveloping side wall. Such ejector diffusor portion typically comprises the drain cup outlet, and is preferably arranged opposite to the nozzle. That is, the nozzle and the drain cup outlet is preferably axially aligned, or at least partly axially aligned, as previously described, by that the centre axis of the nozzle extends into the drain cup outlet.

According to at least one example embodiment, the system comprises a connecting conduit arranged between the drain cup and the heat exchanger, the connecting conduit having a diameter at least twice the diameter of an orifice of the nozzle.

Such size of the nozzle is advantageous and provides an improved ejector function when hot water is supplied to the drain cup via the nozzle. For example, the diameter of the orifice of the nozzle is between 1 mm and 15 mm, such as e.g. between 2 mm and 10 mm, or between 2 mm and 8 mm. For example, the diameter of the connecting conduit, i.e. the diameter of a cross section of the connecting conduit, is between 20 mm and 100 mm, e.g. between 30 mm and 80 mm, e.g. between 30 mm and 60 mm. The connecting conduit is being arranged to transport shower greywater in a main flow direction, and the cross section is perpendicular to such main flow direction. The connecting conduit may e.g. be arranged between the drain cup outlet and the heat exchanger.

According to at least one example embodiment, the nozzle comprises a single opening, or orifice.

According to at least one example embodiment, the nozzle comprises a plurality of openings or orifices, wherein the previously mentioned orifice for example is a first orifice. Moreover, and according to at least one example embodiment, at least one of the plurality of openings or orifices of the nozzle is arranged to face away from the drain cup outlet. Hereby, a detergent (e.g. in the form of granulates) in the drain cup may be transported more efficiently downstream of the drain cup outlet, and further into the heat exchanger by the supplied hot water from the nozzle.

According to at least one example embodiment, the connecting conduit has a diameter of at least half an order of magnitude greater than the diameter of the nozzle orifice, or has a diameter of at least an order of magnitude greater than the diameter of the nozzle orifice.

According to at least one example embodiment, the previously mentioned asymmetrical diverging section of the ejector diffusor portion is arranged such that a top portion of the connecting conduit is in-line or lower than a top portion of the diverging section, and potentially a top portion of the constant area or throat section of the ejector diffusor portion is in-line or higher than the top portion of the diverging section. In other words, the top portion of the diverging section is at the same vertical position as the top portion of the connection conduit or higher, and potentially the same vertical position or lower than a top portion of the constant area or throat section. Thus, the diverging section or connected conduit does not form any compartments in which gas pockets can be formed. Gas pockets, typically air pockets, formed in system may cause gas or air to be transported into the system resulting in throttling e.g. within the heat exchanger. Such throttling may undesirably increase the pressure drop within the system limiting the flow capacity of the system.

According to at least one example embodiment, the drain cup is arranged to at least temporarily hold the shower greywater.

Thus, the drain cup is typically arranged such that shower greywater (or any liquid) is at least temporarily held in the drain cup before being discharged further downstream. That is, the drain cup is typically arranged such that the drain cup is temporarily filled with the shower greywater during use (i.e. when the drain cup is receiving shower greywater from the shower), enabling the drain cup to be filled to a certain level before a steady state is reached in which an equal amount of shower greywater is discharged through the drain cup outlet, as enters via the drain cup inlet.

According to at least one example embodiment, the drain cup is arranged and configured to at least temporarily hold a detergent.

For example, the drain cup is arranged with vertical walls, and any solid detergent (e.g. powder or granulates) may simply be added from the drain cup inlet and kept in the drain cup by resting on a horizontal surface inside the drain cup. If the detergent is a liquid, the system may comprise a closure or seal which may be used to keep the detergent in the drain cup (e.g. when measuring amount of detergent, as explained below, or prior to the addition of hot water supply by the nozzle). According to at least one example embodiment, the drain cup is arranged and configured to hold a detergent.

Typically, the detergent is then transferred into the system for chemical cleaning using supplied hot water from the nozzle.

According to at least one example embodiment, the drain cup comprises a measuring arrangement arranged and configured to measure the amount of detergent added to the system.

Hereby, an easy yet effective means for measuring the amount of detergent is provided. For example, the drain cup may be provided with a measuring scale arranged inside the drain cup.

According to at least one example embodiment, the measuring arrangement is arranged in the drain cup opposite to the nozzle. Hereby, the detergent may be added and measured in a location within the drain cup which is easily accessible for the hot water ejected from the nozzle.

According to at least one example embodiment, the drain cup has a height extending along a vertical axis from a bottom surface to a top cross section of the drain cup, wherein the bottom surface traverse the vertical axis.

Such bottom surface enables e.g. the detergent to be at least temporarily held in the drain cup, and forces the flow of shower greywater to turn from the drain cup inlet to the drain cup outlet. According to at least one example embodiment, the bottom surface is comprised in the previously mentioned bottom wall, and the top cross section is forming the previously mentioned opening, or drain cup inlet. Thus, according to one example embodiment, the height extends from the bottom wall to the oppositely arranged opening or drain cup inlet. For example, the height extends along the enveloping side wall.

According to at least one example embodiment, the bottom surface extends with an angle of 60°-120° relative the vertical axis.

In other words, the bottom surface is at least partly horizontally arranged, e.g. sloping. According to at least one example embodiment, the bottom surface extends perpendicular to the vertical axis. The bottom surface may according to at least one example embodiment be planar. The bottom surface may according to at least one example embodiment be curved.

According to at least one example embodiment, the drain cup is arranged and configured to hold a filtering unit, such as a strainer.

Hereby, debris, such as textile fibers and hair, may be at least partly prevented from entering the drain cup. The filter unit is preferably arranged to cover the opening of the drain cup, i.e. to cover the top cross section and the drain cup inlet, or at least be attached to an enveloping top portion of the drain cup. Hereby, the strainer may act as a splash guard when hot water is supplied via the nozzle, preventing, or at least reducing the risk of hot water splashing out from the opening of the drain cup. Moreover, the strainer may act as a lid for any detergent added into the drain cup.

According to a second aspect of the present inventive concept, a shower or shower cabin is provided. The shower or shower cabin comprises

- a shower arrangement having a shower mixer configured to mix hot water from a hot water supply and pre-heated cold water from a cold water supply, and a shower head fluidly connected to the shower mixer for supplying shower water;
- a shower drain system according to the first aspect of the present inventive concept.

Effects and features of the second aspect of the invention are largely analogous to those described above in connection with the first aspect of the invention. Embodiments mentioned in relation to the first aspect of the invention are largely compatible with the second aspect of the invention, of which some are exemplified below.

Thus, the shower drain system is arranged and configured to pre-heat the cold water from a cold water supply prior to that the cold water (or pre-heated cold water) is supplied to the shower mixer. The cold water may e.g. be tap water. Thus, the shower drain system may be connectable to a tap water supply.

As described in the first aspect of the present inventive concept, the nozzle may be arranged and configured to supply hot water from a hot water supply, e.g. by being fluidly connected to the hot water supply. The hot water supply may be a hot tap water supply as described with reference to the first aspect of the invention. The hot water supply may e.g. be a central hot water supply, potentially arranged to supply hot water also to a shower mixer. The temperature of the hot water in the hot water supply is e.g. between 45° C. and 65° C., preferably between 50° C. and 65° C. The pressure of the hot water at the nozzle may e.g. be between 0.5 and 10 barg, preferably between 1 and 7 barg. Thus, the nozzle may be connected to hot water supply providing a pressure of the hot water of between 0.5 and 10 barg, or between 1 and 7 barg. According to at least one example embodiment, the nozzle is arranged and configured to supply hot water from a hot water supply being different to a heated water supply from a shower mixer. According to at least one example embodiment, the shower or shower cabin is arranged such that the temperature of the hot water is at least 45° C., or at least 50° C. when reaching the nozzle.

According to at least one example embodiment, the nozzle is arranged and configured to supply hot water from the same hot water supply as the shower mixer. According to at least one example embodiment, the nozzle is arranged and configured to supply hot water as hot tap water. Thus, the nozzle may connected to a hot tap water supply, or to a tap water supply.

That is, the same hot water supply is used to supply hot water to the shower mixer, as to supply hot water to the nozzle. Hereby, hot water close to the water distribution system maximum temperature may be used by the nozzle. Thus, the temperature difference between the hot water supplied by the nozzle, and that of the hot water supply, originates only from the heat losses occurring due to transporting the hot water from the hot water supply to the nozzle, and not due to any heat losses or reduction of temperature caused by the shower mixer.

According to a third aspect of the present inventive concept, an alternative shower drain system for recovering thermal energy from a flow of shower greywater is provided.

The alternative system comprises:

a drain cup for receiving shower greywater, the drain cup comprising a first filtering unit for filtering hair and debris from the shower greywater, the first filtering unit having a first mesh with a first mesh size, a heat exchanger arranged downstream of the drain cup, the heat exchanger being configured to heat a flow of incoming cold water with the shower greywater, wherein the system further comprises a second filtering unit arranged downstream of the drain cup, the second filtering unit having a second mesh with a second mesh size being coarser than the first mesh size.

Hereby, an improved shower drain system is provided including enabling easy and effective cleaning of the system. The inventor has realized that by providing a shower drain system comprising a first filtering unit arranged upstream, and a second filtering unit arranged downstream, an efficient removal of debris (such as textile fibers and hair) can be achieved with no, or at least a relatively low, reduction in fluid flow, if the second filtering unit is coarser than the first filtering unit. A coarser filtering unit is here referring to that the mesh size of the corresponding mesh is coarser (i.e. here that the mesh size of the second mesh is coarser than the mesh size of the first mesh). Naturally, having a second filtering unit being finer (i.e. having a finer mesh size) results in an increased removal of debris from the shower greywater, but at the expense of a reduction in fluid flow. However, the inventor has realized that debris downstream of the first filtering unit (i.e. which have passed the first mesh of the first mesh size) have a certain characteristic enabling a surprisingly high removal with a second filtering unit being coarser than the first filtering unit. In more detail, long debris like hair or textile fibers downstream the first filtering unit is mainly oriented along the flow direction of the shower greywater, which facilitates downstream removal of the debris with a relatively coarse filter. Preferably, the shower drain system is arranged and configured to cause a sudden flow change direction, and as the flow suddenly changes direction from axial along a conduit to radial, e.g. in the second filtering unit or in a heat exchanger inlet, enabling a second mesh with a coarser mesh size to efficiently remove remaining debris. For example, the first mesh size is between 0.5 mm and 3 mm, and the second mesh size is between 1.5 mm and 4 mm.

According to at least one example embodiment, the second filtering unit is arranged between the drain cup and heat transfer surfaces of the heat exchanger, e.g. between the drain cup and an inlet of the heat exchanger, or inside the heat exchanger inlet (the inlet of the heat exchanger inlet being arranged and configured for receiving shower greywater from the drain cup).

According to at least one example embodiment, the first filtering unit is a bowl-, cone- or pocket shaped strainer.

Thus, the first mesh is comprised of a bowl-, cone- or pocket shaped strainer. Preferably the strainer is free from corners. Hereby, a non-horizontally, or sloping, strainer surface is provided which is easy to clean. Such strainer surface also provides the function of allowing gas bubbles to escape through strainer and thus avoid blocking the tightly spaced wires in the strainer. According to at least one example embodiment, the first filtering unit is half-spherical.

The filter unit is preferably arranged to cover an opening of the drain cup, or is at least attached to an enveloping top portion of the drain cup. For example, the first filtering unit is arranged at the top of the drain cup, and is arranged to extend from the top and into the drain cup (i.e. the bowl-, cone- or pocket shaped strainer is extending inwards).

According to at least one example embodiment, the drain cup is arranged to at least temporarily hold the shower greywater to form a hydraulic pillar extending above at least a portion of the first filtering unit.

Such hydraulic pillar forces the flow of shower greywater and shower products through the first filtering unit. Preferably, the drain cup is arranged vertically.

According to at least one example embodiment, the second filtering unit is arranged to cover the heat exchanger inlet, or is arranged inside of the heat exchanger inlet.

Hereby, debris removed by the second filtering unit are prevented from travelling further into the heat exchanger, and e.g. fouling the heat transfer surfaces within the heat exchanger. Additionally, or alternatively, the second filtering unit is arranged to cover the cross section of the connecting conduit connecting the drain cup and the heat exchanger.

According to at least one example embodiment, the second filtering unit is removably attached to the heat exchanger.

Thus, the second filtering unit may be removed, cleaned (or otherwise improved) and re-installed into the system, or it may be exchanged.

According to at least one example embodiment, the second filtering unit is a grating or strainer.

Hereby, a simple yet effective means for removing debris by the second filtering unit is provided. Thus, the second mesh is comprised of a grating or strainer. Moreover, by a grating or strainer, the second filtering unit can be cleaned from both sides, as hot water and/or detergent may access both sides of the grating or strainer supporting the debris and deposits, in contrast to fouling on heat exchanger surfaces (which are only accessible from one side).

According to at least one example embodiment, the grating or strainer of the second filtering unit form slits through which the shower greywater is enabled to flow, the slits having a main extension in a direction perpendicular to the intended flow of shower greywater.

As previously discussed, the long and narrow debris in the connecting conduit downstream the first filtering unit is mainly oriented along the flow direction of the shower greywater, why an efficient removal of such debris may be achieved by providing slits oriented perpendicularly to the flow direction of the shower greywater. According to at least one example embodiment, the slits have a main extension in a direction along a cross section of the heat exchanger inlet. According to at least one example embodiment, the slits has a main extension in a direction perpendicular to the axial flow direction of the connecting conduit.

According to at least one example embodiment, each slit has a width and a length forming a slit cross section, wherein the length is twice that of the width.

According to a fourth aspect of the present inventive concept, an alternative shower or shower cabin is provided. The shower or shower cabin comprises a shower arrangement having a shower mixer configured to mix hot water from a hot water supply and preheated cold water from a cold water supply, and a shower head fluidly connected to the shower mixer for supplying shower water;

a shower drain system according to the third aspect of the present inventive concept.

Effects and features of the fourth aspect of the inventive concept are largely analogous to those described above in connection to the third aspect of the inventive concept. Embodiments mentioned in relation to the third aspect of the inventive concept are largely compatible with the fourth aspect of the inventive concept.

According to at least one example embodiment, the shower drain systems of the first and third aspect of the present inventive concept are combined. For example, for the first aspect of the present inventive concept, the filtering unit is a first filtering unit, the first filtering unit having a first mesh with a first mesh size as described in relation to the third aspect of the present inventive concept. The shower drain system further comprises a second filtering unit arranged downstream of the drain cup, the second filtering unit having a second mesh with a second mesh size being coarser than the first mesh size as described in relation to the third aspect of the present inventive concept.

Hereby, an improved shower drain system is provided including enabling of easy and effective cleaning of the system, as described in relation to the first and third aspects of the present inventive concept. Any embodiments mentioned in the third aspect of the present inventive concept are thus applicable to the first aspect of the present inventive concept, and are not repeated here again.

Correspondingly, for the third aspect of the present inventive concept, the drain cup of the shower drain system may comprise a nozzle arranged and configured to supply hot water into the drain cup.

Hereby, an improved shower drain system is provided including enabling of easy and effective cleaning of the system, as described in relation to the first and third aspects of the present inventive concept. Any embodiments mentioned in the first aspect of the present inventive concept (as e.g. related to the nozzle, arrangement and configuration of the nozzle, ejector portion of the drain cup, etc.) are thus applicable to the third aspect of the present inventive concept, and are not repeated here again.

Correspondingly, the shower, or shower cabin of the second or fourth aspects of the present inventive concept, may comprise a shower drain system being a combination of the first and third aspect of the present inventive concept.

For any one of the first, second, third and fourth aspects of the present inventive concept, the heat exchanger is configured to heat a flow of incoming cold water with the shower greywater. The heat exchanger typically comprises a heat exchanger inlet for receiving shower greywater from the drain cup (or connecting conduit) and a heat exchanger outlet for discharging the shower greywater downstream to e.g. a sewer. The heat exchanger typically further comprises a cold water inlet for receiving cold water from a cold water supply and a cold water outlet for discharging the pre-heated cold water to a shower mixer. The cold water may e.g. be cold tap water (i.e. cold water from a tap water resource). The heat exchanger is preferably a plate heat exchanger. The pre-heated cold water may alternatively be supplied to a water heater or an instant heater, prior to being supplied to the shower mixer.

Moreover, for any one of the third and fourth aspects of the present inventive concept, the alternative shower drain system may comprise a third filtering unit arranged in between the first and second filtering units. The mesh size of the third filtering unit may be finer or coarser than the second mesh size of the second filtering unit.

Moreover, for any one of the second and fourth aspects of the present inventive concept, the shower cabin may comprise a shower tray, or alternative be replaced with a shower tray (i.e. a shower cabin without the enclosing walls).

Further features of, and advantages with, the present inventive concept will become apparent when studying the appended claims and the following description. The skilled person realize that different features of the present inventive concept may be combined to create embodiments other than those described in the following, without departing from the scope of the present inventive concept.

BRIEF DESCRIPTION OF THE DRAWINGS

These and other aspects of the present inventive concept will now be described in more detail, with reference to the appended drawings showing an example embodiment of the inventive concept, wherein.

DETAILED DESCRIPTION OF EXAMPLE EMBODIMENTS

Figure 1:
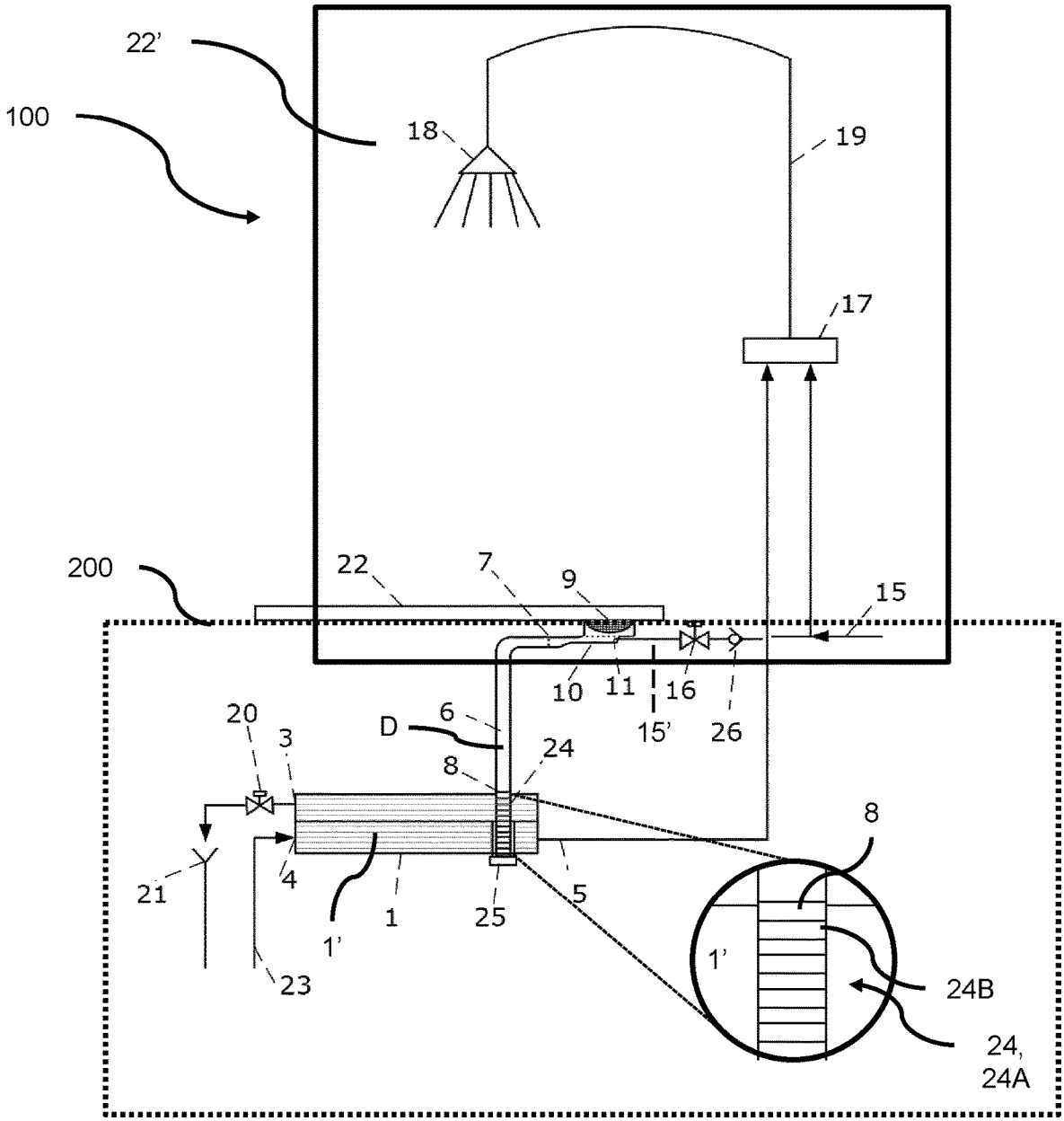
FIG. 1 schematically illustrates a shower or shower cabin comprising a shower drain system for recovering thermal energy from a flow of shower greywater, in accordance with at least some example embodiments of the inventive concept.

In the present detailed description, various embodiments of the inventive concept are described mainly with reference to a shower (or shower cabin) comprising a shower drain system for recovering thermal energy from a flow of shower greywater FIG. 1 is a schematic view illustrating a shower or shower cabin 100. The shower or shower cabin 100 comprises a shower tray or floor 22, and shower walls 22'. The shower walls 22' are either attached to the building in which the shower 100 is installed, or are separated from the building and thus forming part of a shower cabin 100. Correspondingly, the shower tray or floor 22 is either attached to the building (i.e. constituting a shower floor of a shower), or is separated from the building (i.e. constituting a shower tray of a shower cabin) For simplicity, the shower or shower cabin 100 will in the following be described simply as a shower 100, and the shower tray or floor 22, as a shower floor 22.

The shower 100 further comprises a shower mixer 17 and a shower head 18, the shower head 18 being fluidly connected to the shower mixer 17 by a shower conduit 19, being for example a shower hose or shower pipe. The shower mixer 17 is configured to mix hot water from a hot water supply 15, e.g. a hot tap water supply, and pre-heated cold water from a cold water supply, the latter being pre-heated cold water from a heat exchanger 1 as will be described in the following. During use, the shower mixer 17 mixes the desired amount of pre-heated cold water and hot water, supplies the mixed water to the shower head 18 via the shower conduit 19, whereby shower water for showering is provided. The shower water subsequently encounters the shower floor 22, and enters a shower drain system 200 as shower greywater. The shower greywater typically comprises debris, such as textile fibers and hair, as well as grease and shower products, as a result of the showering.

In the following, the shower drain system 200 will be described in further detail. The shower drain system 200 comprises a drain cup 10 for receiving the shower greywater (the drain cup 10 is shown in greater detail in FIG. 2) and a heat exchanger 1 arranged downstream of the drain cup 10. A connecting conduit 6 is fluidly connecting the drain cup 10 and the heat exchanger 1.

The drain cup 10 comprising a first filtering unit 9 for filtering debris from the shower greywater, and a second filtering unit 24 arranged downstream of the drain cup 9 for filtering debris from the shower greywater. Thus, the shower drain system 200 of FIG. 1 comprises two filtering units 9, 24 arranged and configured to filter debris from the shower greywater at different locations in the system 200. In FIG. 1, the first filtering unit 9 is embodied as a first strainer 9, and the second filtering unit 24 is embodied as a second strainer 24.

The heat exchanger 1 of FIG. 1 will now be described in further detail. The heat exchanger 1 comprises a heat exchanger inlet 8 for receiving shower greywater from the drain cup 10 and connecting conduit 6, and a heat exchanger outlet 3 for discharging shower greywater out from the heat exchanger 1 to a sewer or residential drainage 21. The heat exchanger 1 further comprises a cold water inlet 4 for receiving cold water from a cold water supply 23 and a cold water outlet 5 for discharging the pre-heated cold water to the shower mixer 17. Thus, the heat exchanger 1 is configured to heat a flow of incoming cold water from the cold water supply 23 with the shower greywater. In FIG. 1, the heat exchanger 1 is a plate heat exchanger comprising heat transfer surfaces 1' arranged and configured to transfer heat from the shower greywater to the incoming cold water. Note that the heat exchanger 1 of FIG. 1 is schematically illustrated, and that e.g. the heat exchanger 1 may be vertically arranged instead of horizontally arranged, as shown in FIG. 1.

The second strainer 24 is in FIG. 1 arranged to cover the heat exchanger inlet 8 and may be covered by a lid 25. Preferably, the second strainer 24 is removably attached to the heat exchanger 1, and may thus be removed by first removing the lid 25, or be attached to the lid 25, so that the lid 25 and strainer 24 is removed together. The second strainer 24 comprises a second mesh 24A with a second mesh size. In more detail, and as shown in the enlarged view of FIG. 1, the second mesh 24A form slits 24B (only one of the slits 24B is indicated in the enlarged view of FIG. 1) through which the shower greywater is enabled to flow. The slits 24B has a main extension in a direction perpendicular to the intended flow of shower greywater. As noted in FIG. 1, the direction of the flow of shower greywater is forced to rapidly change as it enters the heat exchanger 1 from the connecting conduit 6. Such rapid change in direction of the flow, e.g. a change of flow direction of between 60° and 90°, together with the second strainer 24 and the slits 24B, cause e.g. hair to stuck in the second strainer 24 even though the diameter of the hairs is significantly smaller than the second mesh size.

Figure 2:
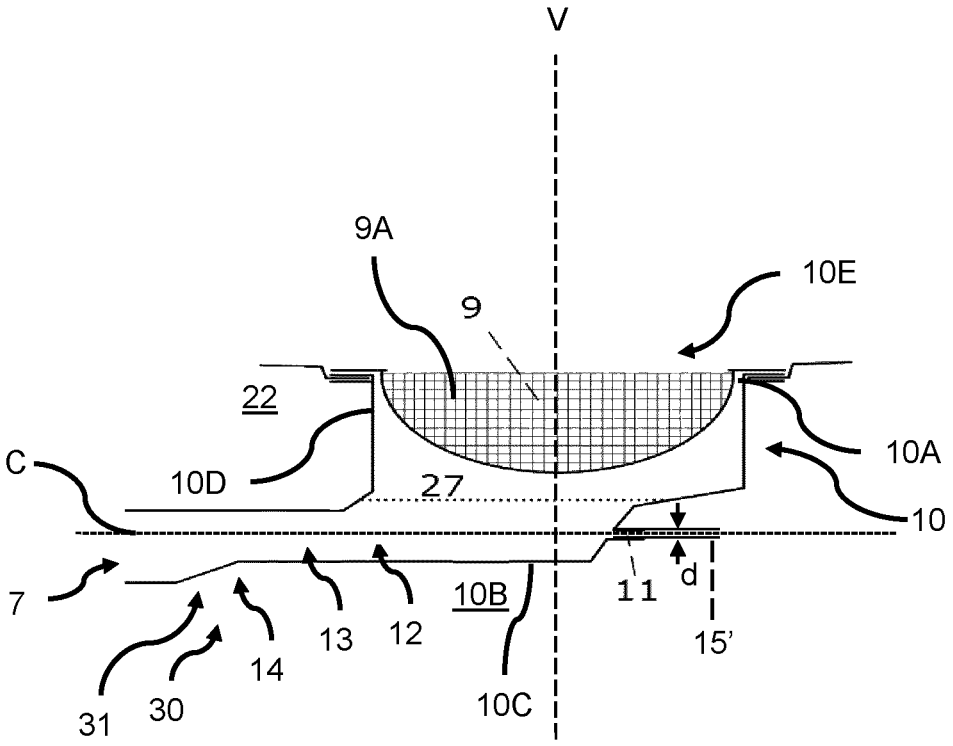
FIG. 2 illustrates a cross-sectional detail of the shower drain system of FIG. 1 according to at least one example embodiment of the inventive concept.

FIG. 2 is a schematic cross-sectional view of the drain cup 10 of FIG. 1. As shown in FIG. 2, the drain cup 10 comprises the first filtering unit 9, or first strainer 9, being shaped as a bowl-, cone- or pocket shaped strainer extending from a top portion of the drain cup 10A and into the drain cup 10. The first strainer 9 comprises a first mesh 9A with a first mesh size. Briefly turning back to FIG. 1 and comparing with FIG. 2, it is evident that the second strainer 24 and the second mesh size of the second mesh 24A is coarser than the first mesh size of the first mesh 9A of the first strainer 9. Hereby, an efficient removal of debris (such as textile fibers and hair) from the shower greywater can be achieved with no, or at least a relatively low, reduction in fluid flow.

In FIG. 2, the drain cup 10 comprises bottom wall 10B with a bottom surface 10C facing into the drain cup 10, and an enveloping side wall 10D extending perpendicular from the bottom wall 10B to an oppositely arranged opening 10E of the drain cup 10. The enveloping side wall 10D preferable comprises an at least partly cylindrically shaped portion. In FIG. 2, the opening of the drain cup 10 forms a drain cup inlet 10E for receiving the shower greywater. Moreover, the drain cup 10 comprises a drain cup outlet 7 for discharging shower greywater downstream to the heat exchanger 1 via the connecting conduit 6.

The drain cup 10 further comprises a nozzle 11 arranged downstream the drain cup inlet 10E and upstream the drain cup outlet 7. In FIG. 2, the nozzle 11 is arranged in the enveloping side wall 10D, facing the drain cup outlet 7. Between the nozzle 11 and the drain cup outlet 7, the drain cup 10 comprises an ejector diffusor portion 30 having a converging section 12, a diverging section 14 arranged downstream of the converging section 12 and a constant area or throat section 13 arranged between the converging section 12 and the diverging section 14. Preferably, the diverging section 14 is asymmetrical to enable gas bubbles to escape back through the drain cup 10 and out via the first strainer 9. That is, the diverging section 14 does not form any compartment in which air or gas can be trapped, as a top portion of the diverging section 14 is in-line with a top portion of the connecting conduit 6, as well as in-line with a top portion of the constant area section 13.

The nozzle 11 is arranged and configured to supply hot water into the drain cup 10, and more specifically into the ejector diffusor portion 30. When hot water is supplied to the drain cup 10 via the nozzle 11, the nozzle 11 and ejector diffusor portion 30 acts as an ejector. In more detail, as a stream, or jet, of hot water is injected by the nozzle 11 towards, and possibly into, the ejector diffusor portion 30, an ejector function is achieved (i.e. a fluid transporting and pumping effect). That is, as shown in FIG. 2, the nozzle 11 and the ejector diffusor portion 30 are axially aligned. Thus, by arranging the nozzle 11 to face the ejector diffusor portion 30, the ejector function is enabled as the fluid in the drain cup 10, and the ejector diffusor portion 30, may be transported and subject to an increased pressure by the supplied hot water from the nozzle 11. A centre axis C of the nozzle 11, indicated by the dashed line C in FIG. 2, thus extends through the orifice of the nozzle 11 and further into the ejector diffusor portion 30. The ejector diffusor portion 30 typically comprises a tubular pipe section 31 having a main extension in the direction of the centre axis C of the nozzle 11. Such tubular pipe section 31 may comprise the converging section 12, the diverging section 14 and the constant area or throat section 13. However, according to at least one example embodiment, the tubular pipe section 31 only comprises one of, or two of, the converging section 12, the diverging section 14 and the constant area or throat section 13. That is, the tubular pipe section 31 may simply be a diverging, converging, or a constant area tubular pipe section, arranged in the drain cup 10 to face the nozzle 11 (e.g. being axially aligned with the nozzle 11 such that the centre axis C at least extends into the tubular pipe section 31).

Briefly turning back to FIG. 1 and comparing with FIG. 2, it is evident that the diameter d of the nozzle 11, or of an orifice of the nozzle 11, is smaller than the diameter D of the connecting conduit 6 at least by a factor 2. Such difference in the diameters d, D is advantageous and provides an improved ejector function when hot water is supplied to the drain cup 10 via the nozzle 11.

As seen in FIG. 1 and FIG. 2, the drain cup 10 is arranged vertically with the bottom surface 10C being planar and extending perpendicular to the vertical axis V. The bottom surface 10C may alternatively be arranged with an angle of 60°-120° relative the vertical axis V. Thus, the height of the drain cup 10 extends along the vertical axis V, and the bottom surface 10C extends perpendicular to the height. Hereby, the drain cup 10 may at least temporarily hold a detergent, such as e.g. a solid detergent, e.g. a detergent in the form of a powder or granulates, as the detergent may be kept in the drain cup 10 at the bottom surface 10C. Moreover, the amount of detergent in the drain cup may be measured or estimated by a measuring arrangement 27, in FIG. 2 embodied as a level marker 27.

Moreover, the drain cup 10 in FIG. 1 and FIG. 2 is arranged and configured to, during use, at least temporarily hold the shower greywater. That is, the drain cup 10 is arranged such that the drain cup 10 may be temporarily filled with the shower greywater during use (i.e. when the drain cup 10 is receiving shower greywater from the shower 100), enabling the drain cup 10 to be filled to a certain amount before a steady state is reached in which an equal amount of shower greywater is discharged through the drain cup outlet 7, as is entered via the drain cup inlet 10E. Hereby, a hydraulic pillar may be formed in the drain cup, the hydraulic pillar extending above at least a portion of the first strainer 9. Such hydraulic pillar forces the flow of shower greywater through the first strainer 9, avoiding easy blockage of the first strainer 9, and avoiding the shower greywater level to rise on the shower floor.

Moreover, various valves 16, 20, 26 may be comprised in the shower 100 and/or shower drain system 200, such as e.g. a first control valve 16 for regulating the flow of hot water to the nozzle 11 via a nozzle connecting conduit 15', a second control valve 20 for regulating the flow of discharged shower greywater from the heat exchanger 1 (and for enabling closing of the system 200 as described below), and a check valve 26 arranged upstream of the first control valve 16 in the hot water supply to the nozzle 11. Such valves are known to the skilled person and is not further elucidated. The control valve 16 may instead of being arranged on the supply line to the nozzle 11, be arranged as a three-way valve between the hot water supply 15, the supply line of hot water to the shower mixer 17 and the supply line of hot water to the nozzle 11. Such three-way valve would prevent simultaneously addition of hot water via the nozzle 11 and the shower mixer 17 and shower head 18. The nozzle connecting conduit 15' typically has a downstream end portion ending in the nozzle 11, and an upstream end portion ending in a coupling to the hot water supply, e.g. tap water, or hot tap water. Thus, the nozzle 11 is typically fluidly coupled to the hot water supply via the nozzle connecting conduit 15'.

As seen in FIG. 1, the shower 100 utilizes the same hot water supply 15 for the hot water input to the shower mixer 17, as for the nozzle 11 (via the nozzle connecting conduit 15'). Hereby, hot water, such as hot tap water, directly from the hot water supply 15, which have not been subject to a temperature reduction in the shower mixer 17 (e.g. by shunting pre-heated cold water into the hot water), can be used. Moreover, by providing hot water directly from the hot water supply 15 (e.g. a tap water supply) to the nozzle 11, a reliable pressure and temperature of the hot water can be assured.

Figure 3:
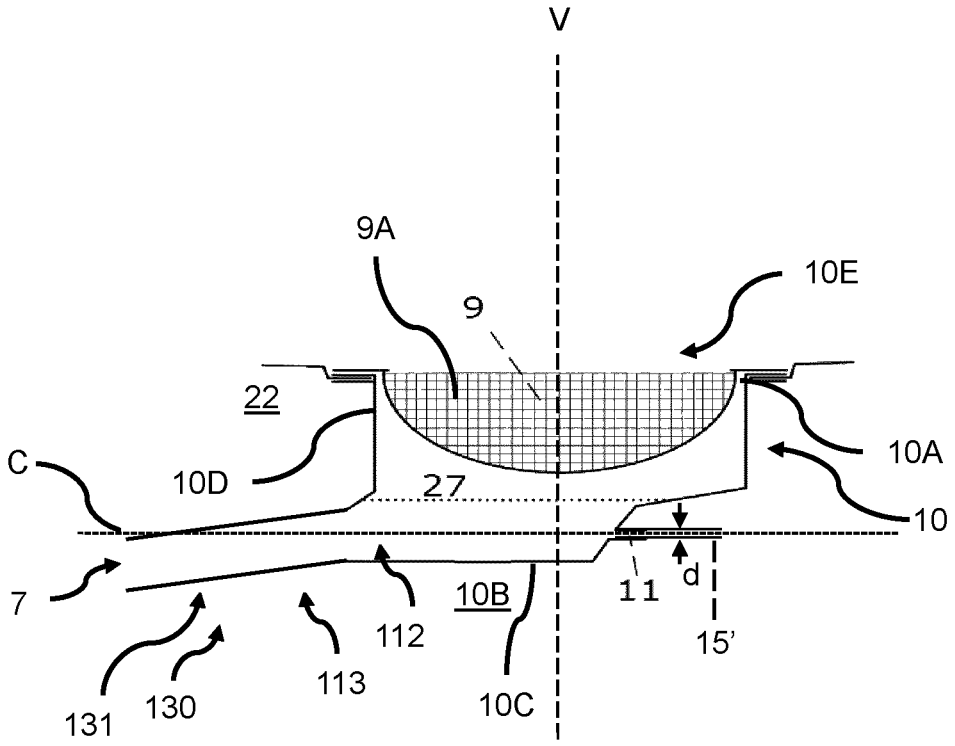
FIG. 3 illustrates a cross-sectional detail of a shower drain system according to at least yet another example embodiment of the inventive concept.

FIG. 3 is a schematic cross-sectional view of a drain cup 110 similar to the drain cup 10 of FIG. 1 and FIG. 2, why only the differences are highlighted below, mainly concerning the ejector diffusor portion 130. Thus, other structures and features not described for the embodiment of FIG. 3 is typically the same, or corresponding to the corresponding structures and features described for the embodiment of FIG. 2, why the same reference numerals are used in FIG. 3 without undue repetition. As shown in FIG. 3, the nozzle 11 and the ejector diffusor portion 130 are at least partly axially aligned, as the centre axis C enters into the ejector diffusor portion 130 but is not parallel to a centre axis of the ejector diffusor portion 130 itself. However, the nozzle 11 is still arranged to face the ejector diffusor portion 130, and the ejector function is thus enabled as the fluid in the drain cup 110, and the ejector diffusor portion 130, may be transported and subject to an increased pressure by the supplied hot water from the nozzle 11. As in FIG. 2, the ejector diffusor portion 130 comprises a tubular pipe section 131 having a main extension slightly inclined relative the centre axis C of the nozzle 11. In FIG. 3 the tubular pipe section 131 only comprises a converging section 112, and a constant area section 113 (thus, no diverging section is present in the tubular pipe section 131 of FIG. 3).

The nozzle 11 is arranged and configured to supply hot water into the drain cup 110, and more specifically into the ejector diffusor portion 130. When hot water is supplied to the drain cup 110 via the nozzle 11, the nozzle 11 and ejector diffusor portion 130 acts as an ejector. In more detail, as a stream, or jet, of hot water is injected by the nozzle 11 towards, and possibly into, the ejector diffusor portion 130, an ejector function is achieved (i.e. a fluid transporting and pumping effect).

The drain cup 110 of FIG. 3 may be used in the shower or shower cabin 100 of FIG. 1 instead of the drain cup 10 of FIG. 2.

The function, and cleaning, of the shower drain system 200 will now be described in further detail.

Rapid fouling and blocking of the shower drain system 200 are prevented via the arrangement and configuration of the shower drain system 200 as shower greywater enters the drain cup inlet 10E, by the first strainer 9 and the second strainer 24 as previously described. For example, by the rapid change in direction of the flow as the shower greywater enters the heat exchanger 1 from the connecting conduit 6, together with the second strainer 24 and the slits 24B, causing e.g. hair to stuck in the second strainer 24 even though the diameter of the hairs is far smaller than the second mesh size.

Cleaning of the shower drain system 200 is performed subsequently to a shower, i.e. when no shower greywater is entering the drain cup inlet 10E (i.e. when the shower or shower cabin is not used for showering). For example, thermal cleaning may be performed by simply opening control valve 16 and supplying hot water into the drain cup 10 by the nozzle 11. The temperature of the hot water is preferably between 50° C. and 55° C. and the pressure is preferably between 1 and 7 barg, causing waxes and grease to melt and be removed together with the supplied hot water eventually to the sewer or residential drainage 21. The hot water supplied by the nozzle 11 furthermore achieves the previously described ejector function improving the cleaning and detains greywater deposits of hair, fibers and grease to backflow onto the shower floor. Moreover, air may be drawn into the system during use of the nozzle 11 to supply hot water into the drain cup 10. Drawn air may form a pulsating effect of the injected hot water by the nozzle 11, further improving the cleaning effect. Such air is not trapped in the system and will be automatically removed during a subsequent flow of shower greywater of an upcoming shower.

Chemical cleaning may additionally, or alternatively, be performed by adding a detergent as previously described. Chemical cleaning is typically preformed subsequently to a shower, i.e. when no shower greywater is entering the drain cup inlet 10E, and typically subsequently to thermal cleaning. During chemical cleaning, the control valve 20 is typically closed, detergent, e.g. in form of a powder or granulates, are added to the drain cup subsequent to a removal of the first strainer 9 (and the amount measured using the measuring arrangement 27) where after the control valve 16 is opened and hot water is supplied into the drain cup 10 via the nozzle 11, distributing the detergent into the system. Subsequent to such chemical cleaning, a thermal cleaning as described above may be performed in order to remove any detergent and dissolved grease and fibrous material from the system. For such thermal cleaning/rinsing, the control valve 20 is typically opened.

Even though the inventive concept has been described with reference to specific exemplifying embodiments thereof, many different alterations, modifications and the like will become apparent for those skilled in the art. For example, the drain cup 10 and its specific configuration with the nozzle 11 and the ejector section 30 may be used without e.g. the second strainer 24. Correspondingly, the configuration with the first strainer 9 having a first mesh 9A with a first mesh size, and second strainer 24 having a second mesh 24A with a second mesh size being coarser than the first mesh size, may be used without the specific configuration of the drain cup 10 (e.g. the nozzle 11 and the ejector diffusor section 30). Also, it should be noted that the heat exchanger 1 may be arranged differently to that of FIG. 1, and e.g. be a tube heat exchanger. Moreover, the shower drain system described herein is applicable for a shower tray (i.e. a shower cabin without the walls).

Additionally, variations to the disclosed embodiments can be understood and effected by the skilled person in practicing the claimed inventive concept, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A shower drain system for recovering thermal energy from a flow of shower greywater comprising:

a drain cup for receiving shower greywater, a heat exchanger arranged downstream of the drain cup, the heat exchanger being configured to heat a flow of incoming cold water with the shower greywater, the drain cup comprising a drain cup inlet for receiving the shower greywater, and a drain cup outlet for discharging shower greywater to the heat exchanger, wherein the drain cup comprises a nozzle arranged and configured to supply hot water into the drain cup, the nozzle being arranged downstream of the drain cup inlet and upstream of the drain cup outlet, and being arranged and configured to face the drain cup outlet.

2. The system according to claim 1, wherein the drain cup is arranged and configured to, when hot water is supplied to the drain cup via the nozzle, act as an ejector by that the hot water acts as a motive fluid, forming a pumping effect within the shower drain system.

3. The system according to claim 1, wherein the drain cup comprises an ejector diffusion portion arranged between the nozzle and the drain cup outlet, the ejector diffusion portion having at least a converging section and/or a diverging section.

4. The system according to claim 3, wherein the diverging section is an asymmetrical diverging section.

5. The system according to claim 1, comprising a connecting conduit arranged between the drain cup and the heat exchanger, the connecting conduit having a diameter at least twice the diameter of an orifice of the nozzle.

6. The system according to claim 1, wherein the drain cup is arranged and configured to at least temporarily hold a detergent.

7. The system according to claim 6, wherein the drain cup comprises a measuring arrangement arranged and configure to measure the amount of detergent added to the system.

8. The system according to claim 1, wherein the drain cup is arranged and configured to hold a filtering unit T such as a strainer.

9. The system according to claim 1, comprising a nozzle connecting conduit arranged to fluidly couple the nozzle to tap water.

10. A shower or shower cabin comprising:

a shower arrangement having a shower mixer configured to mix hot water from a hot water supply and preheated cold water from a cold water supply, and a shower head fluidly connected to the shower mixer for supplying shower water;

a shower drain system according to claim 1.

11. The shower or shower cabin according to claim 10, wherein the nozzle of the shower drain system is arranged and configured to supply hot water from the same hot water supply as the shower mixer.

12. The system according to claim 9, wherein the filtering unit comprises a strainer.

* * * * *